US006817686B1

(12) United States Patent
Whittlesea

(10) Patent No.: US 6,817,686 B1
(45) Date of Patent: Nov. 16, 2004

(54) DRAWER WITH DRAWER SLIDE QUICK-RELEASE MECHANISM

(75) Inventor: John Henry Whittlesea, Northampton (GB)

(73) Assignee: Accuride International Limited, Northampton (GB)

( * ) Notice: Subject to any disclaimer, the term of this patent is extended or adjusted under 35 U.S.C. 154(b) by 18 days.

(21) Appl. No.: 10/110,097

(22) PCT Filed: Oct. 9, 2000

(86) PCT No.: PCT/GB00/03885

§ 371 (c)(1),
(2), (4) Date: Apr. 5, 2002

(87) PCT Pub. No.: WO01/24661

PCT Pub. Date: Apr. 12, 2001

(30) Foreign Application Priority Data

Oct. 7, 1999 (GB) ..... 9923722

(51) Int. Cl.[7] ..... A47B 88/00
(52) U.S. Cl. ..... 312/348.4; 312/330.1
(58) Field of Search ..... 312/330.1, 348.4, 312/348.1, 348.2, 257.1, 263, 334.1

(56) References Cited

U.S. PATENT DOCUMENTS 5,281,021 A 1/1994 Röck et al.
5,364,181 A * 11/1994 Scheible ..... 312/348.4
5,470,143 A 11/1995 Gill
5,580,139 A * 12/1996 Grabher ..... 312/333
5,785,400 A * 7/1998 Grieser et al. ..... 312/334.12
5,860,718 A * 1/1999 Brustle ..... 312/348.4 X

FOREIGN PATENT DOCUMENTS

| | | | | |
|---|---|---|---|---|
| DE | 2839011 | | 3/1980 | |
| DE | 3347540 | * | 7/1985 | |
| DE | 3620450 | * | 1/1987 | ..... 312/348.4 |
| DE | 9401169.9 | * | 5/1994 | |
| EP | 581325 | * | 2/1994 | |
| GB | 2339143 | | 1/2000 | |

* cited by examiner

*Primary Examiner*—James O. Hansen
(74) *Attorney, Agent, or Firm*—Stephen B. Salai, Esq.; Brian B. Shaw, Esq.; Harter, Secrest & Emery LLP

(57) ABSTRACT

A drawer and drawer slide combination which incorporates a spring clip for providing a quick-release mechanism between the drawer (1) and drawer slide (17) is disclosed. Thd spring clip (25) is secured to an inner slide member (19) of the drawer slide (17) and is formed of a spring material and has an inwardly extending latching projection (29) which engages with a vertically extending latching surface (13) provided in a recess (11) at the front side edge of the drawer, said recess (11) being provided by securing a drawer front (7) to the front of the drawer (1) in spaced relationship thereto. In order to provide vertical latching between the drawer and drawer slide, apertures (15) are provided in the rear face of drawer front (7) which are engaged by locating tongues (23) projecting from the front edge of the inner member (19) of the drawer slide.

16 Claims, 2 Drawing Sheets

DRAWER WITH DRAWER SLIDE QUICK-RELEASE MECHANISM

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "SEQUENCE LISTING"

Not applicable

BACKGROUND OF THE INVENTION

1. Field of the Invention

This invention relates to a drawer and drawer slide incorporating a quick-release mechanism between the drawer slide and the drawer.

2. Background Art

Nowadays, office furniture and the like which incorporates one or more drawers normally has each drawer mounted within a frame by means of a pair of drawer slides so as to reduce friction and hence, wear between the drawer and the frame. Drawer slides are well known and comprise at least two longitudinally extending members, slidable relative to one another, there usually being a plurality of ball bearings arranged between the two relatively slidable members, one of which is secured to the frame and the other to the drawer. It is preferred that some form of releasable coupling is provided so that the drawer can simply be removed from the frame and furthermore, so that the drawers are easily assembled within the frame.

A quick-release connecting clip of the above type is known in which a deformed spring steel clip has one end connected by riveting to the slide, and the other, kinked end terminates in a step so as to provide a projecting nose engageable within an aperture in the side wall of the drawer. This aperture in the side wall is spaced somewhat rearwardly from 20 the front of the side wall. This construction of connecting clip suffers from the disadvantage that it is made of spring steel and has to be pre-connected to the slide. Furthermore, because of the construction of the clip, it is possible for the clip to become disengaged from the aperture within the side wall of the drawer when, for example, the drawer is opened quickly and reaches the end of its travel. If the drawer is full of papers, it will be extremely heavy and substantial forces will be borne by the clip, which can cause the clip to deform and become disengaged from the drawer.

In another known arrangement, two clips are provided, one being located between the drawer front and front of the drawer slide to provide a vertical latch, and one between the 30 top of the slide and the drawer to provide a fore and aft latch. Such a double clip arrangement has its obvious disadvantages.

In our European Patent Application No. 99305264.6, we disclose a quick release connection in which a clip having a projection thereon is biased into engagement with an aperture so that the projection provides both fore-and-aft and vertical latching between the drawer and an inner slide member of one (or both) of the drawer slides.

The present invention seeks to provide an improved design of drawer slide and drawer, with a quick-release mechanism between the drawer slide and drawer, which is very simple to manufacture and fit, and is thus inexpensive.

BRIEF SUMMARY OF THE INVENTION

According to the present invention, we provide a drawer and drawer slide combination incorporating a quick-release mechanism between the drawer slide and drawer, the combination comprising a drawer, at least one drawer slide comprising at least two slide members slidable relative to one another, an external one of said members being connectable to a framework and an inner one of said members being connectable to the drawer and a clip having a fixing part by means of which it may be connected to one of the inner slide member and the drawer, and a latching part having a projection thereon for engagement with a recess having a latching surface extending normal to the sliding directions of the drawer, said recess being located in the other of the inner slide member and the drawer, the latching part being moveable between a first position in which the projection engages with the recess to connect the drawer to the inner slide member and a second position in which it is disengaged from the recess to allow disconnection of the drawer from the inner slide member, and wherein at least one locating tongue extends between a front end of the inner slide member and a front of the drawer and engages within an aperture in that one of the inner slide member and front of the drawer from which the at least one locating tongue does not project, to provide vertical latching and horizontal latching transverse to the sliding directions of the drawer, between the drawer and the inner slide member.

In one construction, the clip is formed of two separate parts, one comprising the fixing part, and the other comprising the latching part, which may be spring loaded; in this construction, co-operating means are provided on each part to assist in holding them together in use, with the spring bias to the latching part being provided by a leaf spring portion on the fixing part, and the latching part being held in position, in use, by being sandwiched between the fixing part and the one of the inner slide member and the drawer to which the fixing part may be connected.

In another construction, the clip is a single moulded part which preferably incorporates a spring bias to the latching part provided by moulding the latter in a material which is resiliently deformable with a set, whereby when relaxed, it will take up its first position.

Preferably, the at least one locating tongue is located on a front edge of the inner slide member and engages within an aperture provided in a rear face of a drawer front. More preferably, two vertically spaced locating tongues are provided on the front edge of the inner slide member, each engaging in one of a pair of co-operating, vertically spaced apertures in a rear face of the drawer front.

Preferably, the drawer front is secured to a front of the drawer such that it is spaced a short distance from the front of the drawer, thus leaving a space between the front of the drawer and the rear of the drawer front, at each side edge of the drawer slide, which spaces provide recesses on each side of the drawer, with which a projection on a clip provided on each side of the drawer engages.

Preferably hook means is provided at a rear end of the slide which engages with a rear end of the drawer to prevent relative up and down movement between the drawer and slide at the rear of the drawer.

Preferably, there are means on or able to act on the latching part to enable the part to be moved between its first and second positions.

BRIEF DESCRIPTION OF THE SEVERAL VIEWS OF THE DRAWING(S)

A preferred embodiment of the present invention is now described, by way of example, with reference to the accompanying drawings, in which.

DETAILED DESCRIPTION OF THE INVENTION

Figure 1:
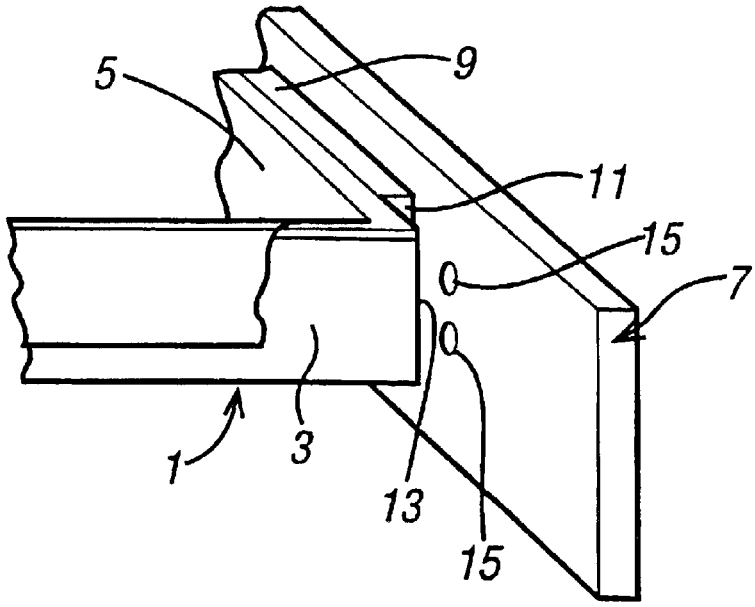
FIG. 1 is a perspective view of a front corner of a drawer having a drawer front (but no drawer slide)

Referring to FIG. 1 of the drawings, a drawer 1, which may be formed of steel, plastics or other material, has a side wall 3 and a front wall 5. A drawer front 7 is connected to the front wall 5, in spaced relationship thereto, by a spacer member 9, the width of which is somewhat less than that of the drawer, so as to leave a recess 11 at the front of the drawer, at each side thereof. A front face of the drawer defines a vertical latching surface 13 in 15 said recess 11. Two apertures 15 are provided in the rear face of the drawer front 7.

Figure 2:
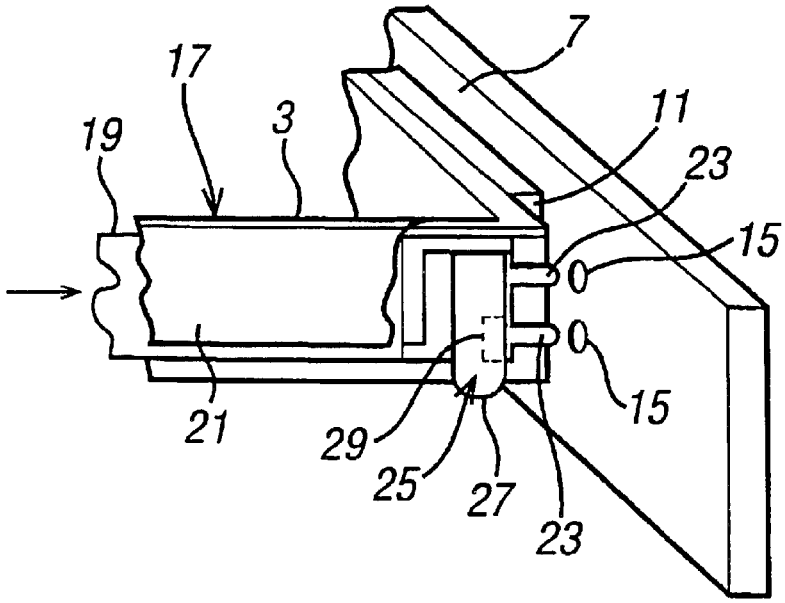
FIG. 2 is a perspective view similar to FIG. 1, but showing the drawer slide in position and disconnected from the drawer (with part of the slide broken away)
Figure 3:
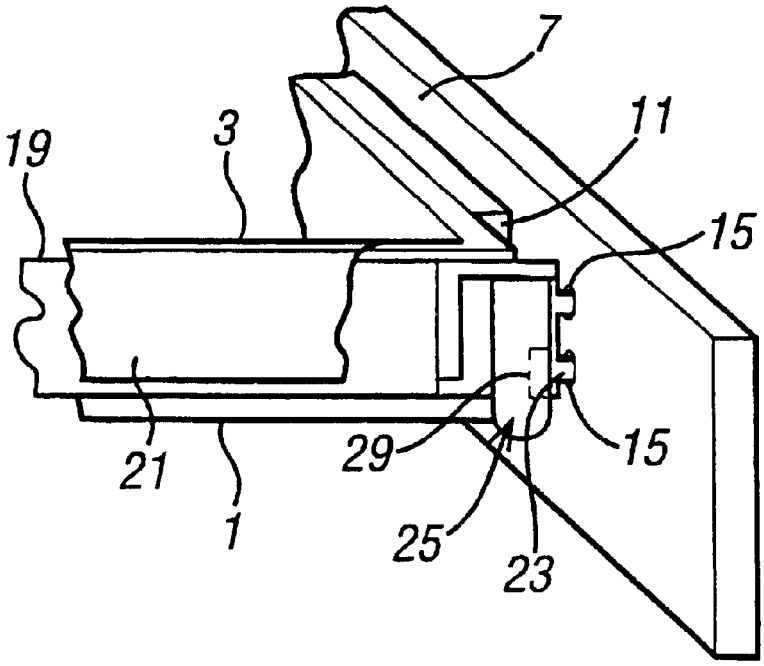
FIG. 3 is a perspective view similar to that of FIG. 2, but showing the slide connected to the drawer.
Figure 4:
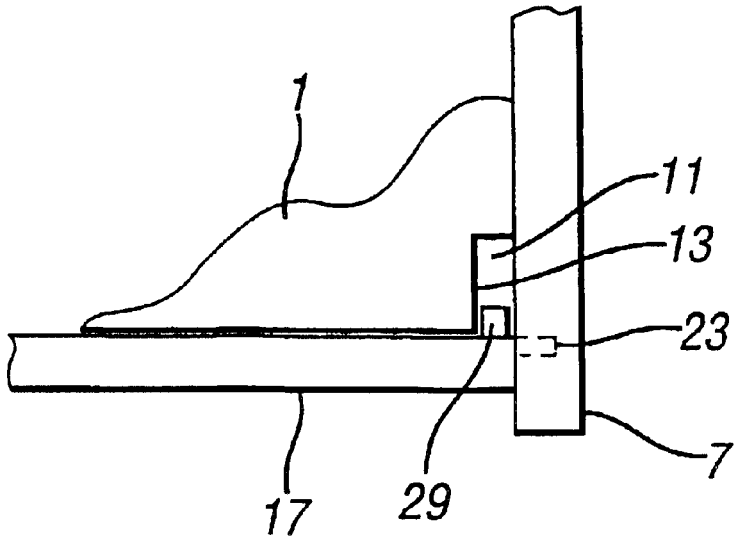
FIG. 4 is a partly schematic plan view, showing how the drawer is connected to the drawer slide.

As can be seen from FIG. 2, the drawer 1 is designed for use within a carcase or framework, e.g. of a desk (not shown) and is located for sliding movement therein by a drawer slide 17 located on each side of the drawer 1. As is well known in the art, a drawer slide has two or three relatively slidable drawer slide members, the drawer slide in FIG. 2 having only an inner drawer slide member 19 connected to the side wall 3 of the drawer, and an outer drawer slide member 21, for connection to the carcase or framework (not shown). When the drawer 1 and drawer-slide 17 are assembled together, they are held in close side-by-side relationship by virtue of a tongue on the rear end of the drawer slide 17 engaging in an aperture provided in the rear of the drawer, and by means of two projecting locating tongues 23 on the front of the inner slide member 19 engaging in the apertures 15 in the drawer front 7. Not only do these tongues 23 hold the slide 17 against lateral movement away from the drawer 1, they also prevent relative vertical movement between the two.

In order to provide fore-and-aft latching between the drawer slide 17 and the drawer 1, a spring clip 25 is connected to the inner slide member 19. This clip may be generally of the construction disclosed in the specification of our co-pending European Patent No. 99305264.6 with a fixing part by means of which it is connected to the slide member 19, a depending part 27 and a latching part 29 for engagement within the recess 11. The clip is designed so that when in a position of rest, the latching part 29, which is in the form of a projection on the inner face of the clip, will engage the latching surface of the recess 11, and by virtue of the clip's connection, via its fixing part, to the slide member 17, the drawer 1 will be held in latching engagement with the drawer slide 17.

To assemble a drawer 1 with the drawer slide 17 and connect the two together, the spring clip 25 is first of all located within and attached to the slide member 19 of the drawer slide 17, e.g. as disclosed in our said earlier European patent application. In practice, there will, of course, be two drawer slides, one for each side of the drawer with the respective slide members 17 facing one another and each will be provided with a spring clip 25 having its projection or latching part 29 extending inwardly so as to project beyond the inside face of the slide. A drawer 1 is then placed over the two drawer slides and the front of the drawer 15is then connected to the drawer slides by pushing the drawer downwards relative to the drawer slides and holding the two spring clips, by applying outward pressure to the depending parts 27 to hold the latching parts out of the way. When the drawer 1 is correctly located between the two slides 17, the two inner slide members 19 are moved forwardly so as to engage the locating tongues 23 in the respective apertures 15 in the 20 drawer front 7, whereupon the spring clips 25 can be released to allow their latching parts 29 to engage within the recesses 11. Then the rear end of the drawer can be attached to the slides by causing the tongues on the rear of the slides to engage in the apertures provided for the purpose in the rear of the drawer. Once so engaged, it is important that the front end of each drawer slide is held closely alongside the side walls of the drawer 1 because, 25 when the drawer is opened and is full, and the drawer slide reaches the forward most part of its extension capability, the momentum of a full drawer has to be absorbed almost completely by the spring clips 25. If the slide member 19 of each drawer slide is held closely adjacent its respective drawer side wall, there is virtually no twisting of drawer 1 relative to slide member 19 and this means that the forces acting on the spring clips due to 30 the momentum of a full drawer are taken almost completely as shear forces. This means that the spring clips can be moulded from plastics material which is strong in shear, but not in twisting.

The above-described quick-release mechanisms are located at the very front of the drawer and the drawer slides. This means that when it is desired to disconnect a drawer from its drawer slide, this is a very simple operation by the user applying finger pressure to the portion 27 on the lower end of the spring clip 25). This will move the clip against its spring bias, thus moving the projecting latching part 29 out of the recess in the side of the drawer, thus allowing the tongues 23 to be removed from the apertures 15 and allowing the drawer to be removed not only from its slide but also from the framework in which the whole mechanism is located.

It is an important feature of the present invention that the latching faces on the latching parts 29 and in the recesses 11 in the side walls of the drawer extend generally at right angles to the side walls of the drawer. This means that when a drawer is opened or closed and suddenly stopped, the forces between the drawer and its drawer slides are accommodated by these surfaces which are normal to the direction of movement of the drawer. This means that there is no twisting on the spring clips which would otherwise tend to cause them to become disengaged. This is a major advantage of the clips of the present invention over the first mentioned prior art clip described above.

Although the clips of the present invention are preferably of one piece construction and 20 moulded from plastics material, they could be formed of a springy metal and have alternative constructions, similar to the two piece construction disclosed in our said European patent application.

It will, of course, be understood that the present invention has been described above purely 25 by way of example, and modifications of detail can be made within the scope of the invention.

For example, instead of the tongues 23 projecting forwardly from the slide members 19, and engaging in the apertures 11, the apertures could be replaced by rearwardly extending 30 projections on the drawer front which would engage within apertures in the front of the slide members 19.

What is claimed is:

1. A drawer and drawer slide combination incorporating a quick-release mechanism between the drawer slide and drawer, the combination comprising a drawer, at least one drawer slide comprising at least two slide members slidable relative to one another, an external one of said members being connectable to a framework and an inner one of said members being connectable to the drawer and a clip having a fixing part adapted to be connected to one of the inner slide member and the drawer, and a latching part having a projection thereon adapted to engage a recess having a latching surface extending normal to the sliding directions of the drawer, said recess being located in the other of the inner slide member and the drawer, the latching part being moveable between a first position in which the projection engages with the recess to connect the drawer to the inner slide member and a second position in which it is disengaged from the recess to allow disconnection of the drawer from the inner slide member, and wherein at least one locating tongue extends from one of a front end of the inner slide member and a front of the drawer and engages within an aperture in the other of the inner slide member and front of the drawer to provide vertical latching and horizontal latching transverse to sliding directions of the drawer, between the drawer and inner slide member.

2. The combination as claimed in claim 1, wherein the at least one locating tongue is located on a front edge of the inner slide member and engages within an aperture provided in a rear face of the drawer front.

3. The combination as claimed in claim 2 wherein the drawer front is secured to a front of the drawer such that it is spaced a short distance from the front of the drawer, thus leaving a space between the front of the drawer and the rear of the drawer front at each side edge of the drawer, which spaces provide recesses on each side of the drawer with which a projection on a clip provided on each side of the drawer engages.

4. The combination as claimed in claim 3 including means on or able to act on the latching part to enable the part to be moved between its first and second positions.

5. The combination as claimed in claim 2, wherein two vertically spaced locating tongues are provided on the front edge of the inner slide member, each engaging in one of a pair of co-operating, vertically spaced, apertures in a rear face of the drawer front.

6. The combination as claimed in claim 5 wherein the drawer front is secured to a front of the drawer such that it is spaced a short distance from the front of the drawer, thus leaving a space between the front of the drawer and the rear of the drawer front at each side edge of the drawer, which spaces provide recesses on each side of the drawer with which a projection on a clip provided on each side of the drawer engages.

7. The combination as claimed in claim 2 including means on or able to act on the latching part to enable the part to be moved between its first and second positions.

8. The combination as claimed in claim 1 wherein two vertically spaced locating tongues are provided on the front edge of the inner slide member, each engaging in one of a pair of co-operating, vertically spaced, apertures in a rear face of the drawer front.

9. The combination as claimed in claim 8 wherein the drawer front is secured to a front of the drawer such that it is spaced a short distance from the front of the drawer, thus leaving a space between the front of the drawer and the rear of the drawer front at each side edge of the drawer, which spaces provide recesses on each side of the drawer with which a projection on a clip provided on each side of the drawer engages.

10. The combination as claimed in claim 8 including means on or able to act on the latching part to enable the part to be moved between its first and second positions.

11. The combination according to claim 1 wherein the spring clip is of molded construction.

12. The combination as claimed in claim 11, wherein the clip is formed of resilient plastic material.

13. The combination as claimed in claim 1 including means on or able to act on the latching part to enable the part to be moved between its first and second positions.

14. A slide assembly for a drawer comprising:

at least two slide members slidable relative to one another, an external one of said members being connectable to a framework and an inner one of said members being connectable to a drawer;

a clip having a fixing part adapted to be connected to one of the inner slide member and a drawer, and a latching part having a projection thereon adapted to engage a recess having the latching surface extending normal to the sliding directions of a drawer, said recess being located in the other of the inner slide member and a drawer, the latching part being moveable between the first position in which the projection engages with the recess to connect the drawer to the inner slide member and a second position in which it is disengaged from the recess to allow disconnection of the drawer from the inner slide member; and wherein at least one locating tongue extends from one of a front end of the inner slide member and a front of the drawer and engages within an aperture in the other of the inner slide member and front of the drawer to provide vertical latching and horizontal latching transverse to sliding directions of the drawer, between the drawer and inner slide member.

15. A slide assembly for a drawer comprising:

at least two slide members;

at least one locating tongue extending from one of: a front end of one of the slide members and a front of a drawer, and engaged within an aperture in the other of the one of the slide members and front of the drawer, to provide vertical latching and horizontal latching transverse to sliding directions of the drawer, between the drawer and respective slide member; and a clip having a fixing part adapted to be connected to one of the slide members and the drawer, and a latching part having a projection thereon adapted to engage a recess having a latching surface extending normal to the sliding directions of the drawer, said recess being located in the other of the respective slide member and the drawer, the latching part being moveable between a first position in which the projection engages with the recess to connect the drawer to the respective slide member and a second position in which the projection is disengaged from the recess to allow disconnection of the drawer from the respective slide member.

16. A slide assembly for a drawer comprising:

a clip having a fixing part adapted to be connected to one of a slide member and a drawer, and a latching part having a projection thereon adapted to engage a recess having a latching surface extending normal to the sliding directions of the drawer, said recess being located in the other of the slide member and the drawer, the latching part being moveable between a first position in which the projection engages with the recess to connect the drawer to the slide member and a second position in which the projection is disengaged from the recess to allow disconnection of the drawer from the slide member; and at least one locating tongue extending from one of a front end of the slide member and a front of the drawer and engaged within an aperture in the other of the slide member and front of the drawer to provide vertical latching and horizontal latching transverse to sliding directions of the drawer, between the drawer and slide member.

* * * * *